US007046163B2

(12) United States Patent
Macey

(10) Patent No.: US 7,046,163 B2
(45) Date of Patent: May 16, 2006

(54) TWO-WAY RF REMOTE CONTROL

(75) Inventor: Stephen S. Macey, Oceanside, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 820 days.

(21) Appl. No.: 09/865,010

(22) Filed: May 24, 2001

(65) Prior Publication Data

US 2002/0175828 A1 Nov. 28, 2002

(51) Int. Cl.
*G08C 19/00* (2006.01)

(52) U.S. Cl. ..... 340/825.72; 340/825.69

(58) Field of Classification Search ..... 340/825.72, 340/825.69; 4/492, 496, 605, 661, 695, 696; 381/152, 124; 345/168; 700/17
See application file for complete search history.

(56) References Cited

U.S. PATENT DOCUMENTS 4,404,697 A * 9/1983 Hatcher ..... 4/492
6,516,070 B1 * 2/2003 Macey ..... 381/152
2002/0070875 A1 * 6/2002 Crumb ..... 340/825.69

* cited by examiner

*Primary Examiner*—Michael Horabik
*Assistant Examiner*—William Bangachon

(57) ABSTRACT

A spa system including a remote control for controlling operation thereof. The system includes a remote control module having a microprocessor and memory therefor, which is receptive to push-button inputs. The remote control has a display and an antenna for transmitting signals to the spa and for receiving signals back from the spa. A master control module resides within the spa for controlling and sensing a multiplicity of functions of the spa. A slave control module is coupled to the master control module and also has an antenna responsive to command signals received from the remote control, and for transmitting status signals back to the remote control. The slave control module is used for converting the command signals received from the remote control for the master control, and for converting status signals received from the master control for transmission back to the remote control.

19 Claims, 9 Drawing Sheets

10
11
12
13
MODE
16
17
15
MAIN
CONTROL

TWO-WAY RF REMOTE CONTROL

CROSS-REFERENCE TO RELATED APPLICATION

This application relates to U.S. patent application Ser. No. 09/865,127, entitled SPA AUDIO SYSTEM OPERABLE WITH A REMOTE CONTROL, filed on the same date hereof, and now U.S. Pat. No. 6,516,070 granted Feb. 4, 2003.

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND OF THE INVENTION

1. Field of the Invention

The present invention relates to an apparatus for remotely controlling other systems or apparatus and further being adapted for receiving feedback signals indicative of the state of the controlled apparatus.

2. Description of Related Art

Most remote controls, such as those we use today for our home entertainment devices use an infrared beam for communication. Some use sounds above our audible range. In any event, these prior art remote devices are one way only. That is, they will transmit a command signal to a device but are not adapted to receive a response, such as a device status signal.

Therefore, a need exists for a remote control that can not only transmit commands to a controlled slave unit, but can also receive feedback status signals from the slave unit. Moreover, there is a need for a radio frequency ("RF") remote control device that can communicate between walls or windows.

SUMMARY OF THE INVENTION

These and other objects, which will become apparent as the invention is described in detail below, wherein a spa system includes a remote control for controlling operation thereof. The system includes a remote control module having a microprocessor and memory therefor, which is receptive to push-button inputs. The remote control has a display and an antenna for transmitting signals to the spa and for receiving signals back from the spa. A master control module resides within the spa for controlling and sensing a multiplicity of functions of the spa. A slave control module is coupled to the master control module and also has an antenna responsive to command signals received from the remote control, and for transmitting status signals back to the remote control. The slave control module is used for converting the command signals received from the remote control for the master control, and for converting status signals received from the master control for transmission back to the remote control.

An object of the present invention is to provide a remote control for a spa that can receive a return signal indicative of the status of a given function of the spa.

Another object of the present invention is to provide feedback from the spa that indicates such things as water temperature, power-on, status of jets and whether or not a water-jet pump is on.

Still another object of this invention is to provide a remote control that can sense the present temperature and set a desired temperature.

Yet another object of this invention is to provide a remote control that is simple to use by employing only 3-button controls—1 button for mode and 2 buttons for ON or OFF/increase or decrease of the selected mode.

Still other objects, features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims. The present invention will become apparent when taken in conjunction with the following description and attached drawings, wherein like characters indicate like parts, and which drawings form a part of this application.

BRIEF DESCRIPTION OF THE DRAWINGS

The general purpose of this invention, as well as a preferred mode of use, its objects and advantages will best be understood by reference to the following detailed description of an illustrative embodiment with reference to the accompanying drawings in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved RF remote control apparatus for controlling other systems or apparatus.

Figure 1:
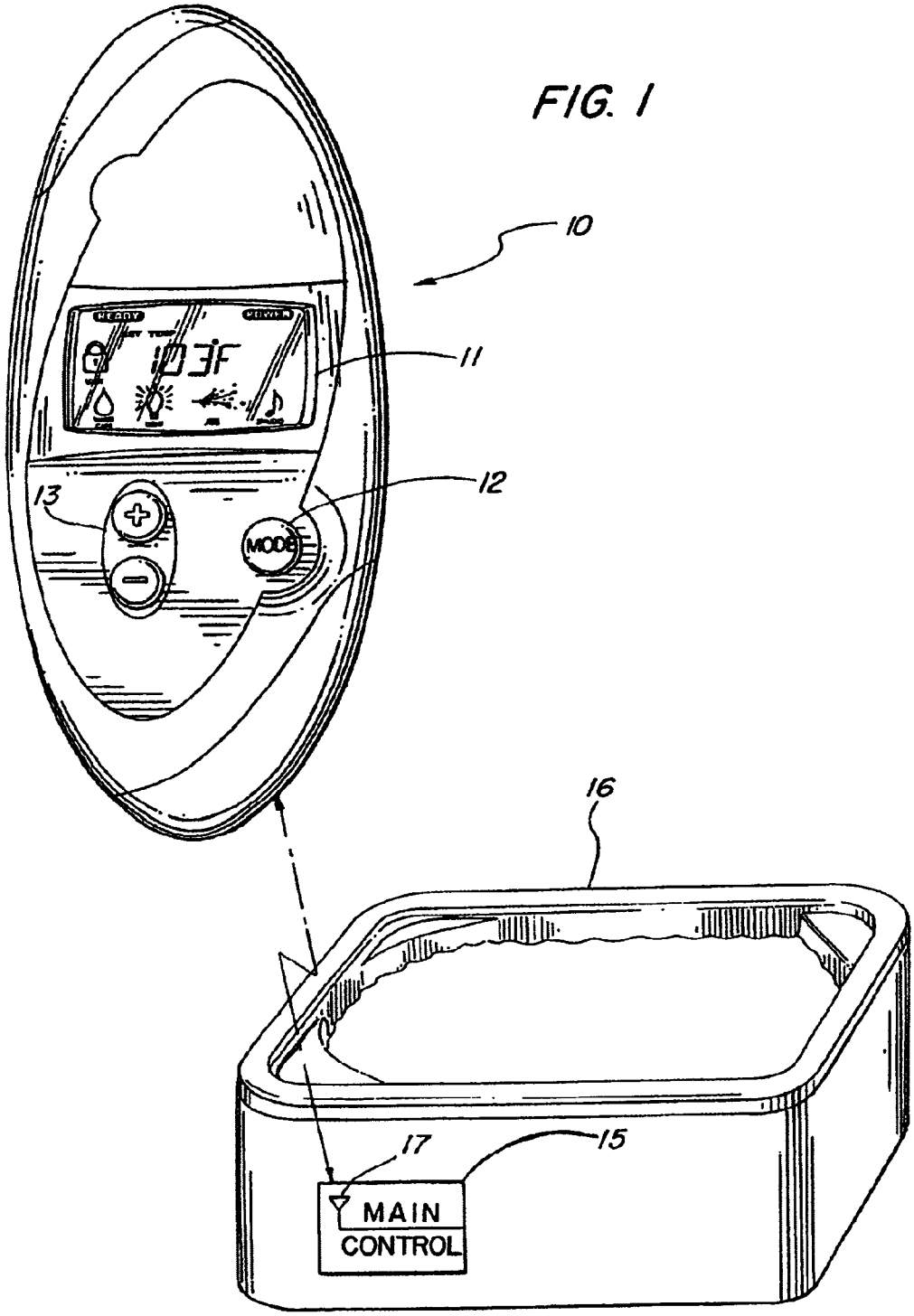
FIG. 1 illustrates the remote control in accordance with a specific embodiment of the present invention.

Referring now to the drawings and FIG. 1 in particular, a remote control 10 is illustrated. RF signals from the remote control 10 are low power, but adequate to reach an antenna 17 within a spa 16. The power is preferably low to avoid interference with a neighbor's radio or television reception. The remote control 10 also receives status signals back from the spa regarding the status of such things as water temperature, and the like as will be explained in greater detail hereafter.

The remote control 10 includes a display 11 having icons displayed thereon, which represent various functions to be amplified hereinafter. The remote control 10 also includes a mode button 12 for changing the function of the remote from one mode to another; and, a switch 13 having a pair of buttons marked +/– ("ON/OFF" or "increase/decrease") for use in conjunction with the mode button 12 for changing or setting a function. The remote control 10 is preferably powered by three AAA batters, is preferably waterproof and is preferably capable of floating in water.

According to a specific embodiment of the present invention, the remote control 10 operates under the control of a master or main control 15 located within a spa 16. The main control 15 receives signals from the remote control 10 via an antenna 17, and transmits information to the remote control by the same antenna 17.

Figure 2:
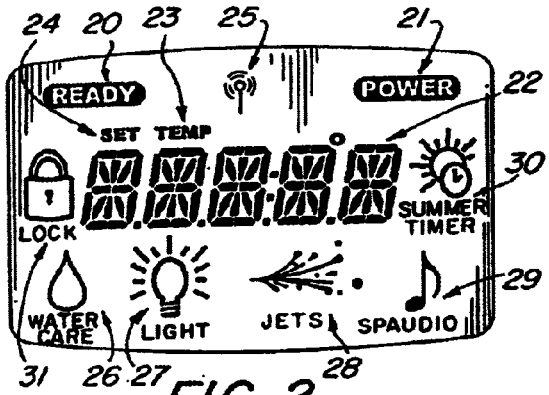
FIG. 2 is a more detailed diagram of the display of the remote control of the present invention.

Referring now to FIG. 2, the display 11 of the remote control 10 is shown in greater detail. The display 11 includes numerous icons, which indicate the status of various functions of the spa 16. A Ready Light icon 20 will illuminate when the temperature of the water in the spa 16 is within 2 degrees of the selected temperature. A Power Light icon 21 will illuminate when the spa system is turned on and power is connected.

An Alpha/Numeric display array 22 is disposed for indicating numerous functions selected by the mode switch 12, or for displaying information received back from the master control 15. For example, when the temperature mode is selected by pressing the mode button 12 (FIG. 1), a Temp Light icon 23 illuminates and the temperature of the water 23A is indicated by the display array 22. When a temperature set mode is selected by the mode button, a Set icon 24 will illuminate. As the +/– switch 13 or buttons 13 are pressed, the temperature is moved up or down as selected and is shown by the display array 22. As the remote control 10 communicates with the master control 15, a Comm icon 25 will flash, which indicates communication is taking place between the two units.

Additional functions indicated by the display 11 on the remote control 10 include a Water Care icon 26, which when illuminated indicates that the sanitary system of the spa 16 is operating normally or not. A Light icon 27 will illuminate when the mode switch 12 selects the spa light function. In the spa light mode, depressing the + button of the switch 13 will turn the spa light 27 on, and depressing the – button of the switch 13 will turn the spa light off.

In a similar fashion, when the mode switch 12 has selected the jets mode, a Jets icon 28 illuminates and the jets of the spa can be turned on and off using the buttons of Switch 13. A SpAudio icon 29 illuminates when the mode switch 12 is stepped to this function. When the + button of the switch 13 is depressed, the SpAudio turns on. In a similar manner, when the – button of the switch 13 is depressed, the SpAudio turns off. The SpAudio feature is explained in greater detail in the U.S. patent application Ser. No. 09/865,127, entitled SPA AUDIO SYSTEM OPERABLE WITH A REMOTE CONTROL, filed May 24, 2001, now U.S. Pat. No. 6,516,070, and assigned to the assignee hereof.

A Summer Timer light icon 30 illuminates when the mode switch 12 is stepped to this function, and when the + of switch 13 is depressed, this function is turned on. In a similar manner, when the – button of this switch 13 is depressed, this function is turned off.

The Summer Timer function is useful in a warm climate. For example, in a place like Arizona in the summer time the ambient temperature may be quite high. A feature of the spa 16 is to continuously circulate the water by the heater to maintain a set temperature. In a warm climate, when using the water circulate feature, the water temperature may rise above a desired setting. Accordingly, by turning on the Summer Timer function, the water is not circulated continuously. This helps to maintain the pre-set desired temperature.

Another function indicated by the display 11 is a Lock icon 31. The Lock function can do two things. First, the entire spa system can be locked so that no one can make changes to the settings—unless they have the remote control. Secondly, the temperature setting can be locked to a pre-selected setting while the other functions are not locked.

Figure 3A:
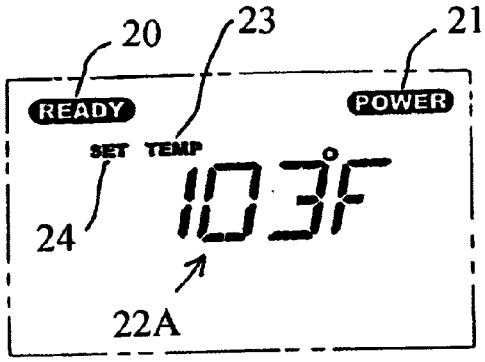
FIGS. 3A–3E illustrate a variety of data displays for the remote control shown in FIGS. 1 and 2.
Figure 3B:
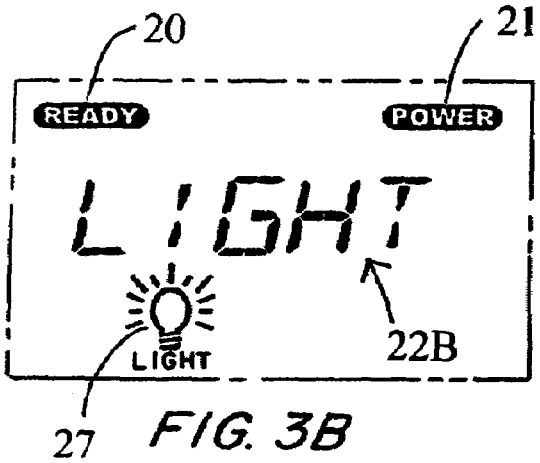
Figure 3C:
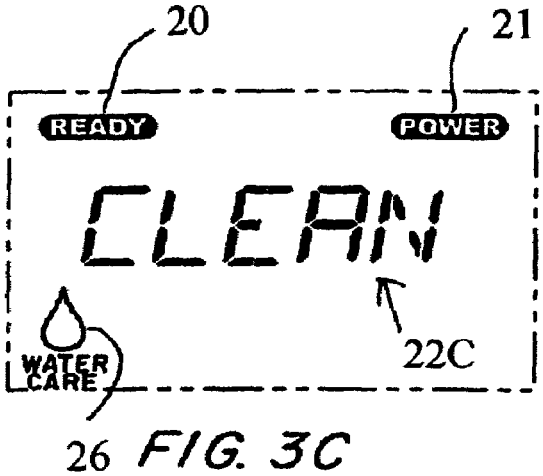
Figure 3D:
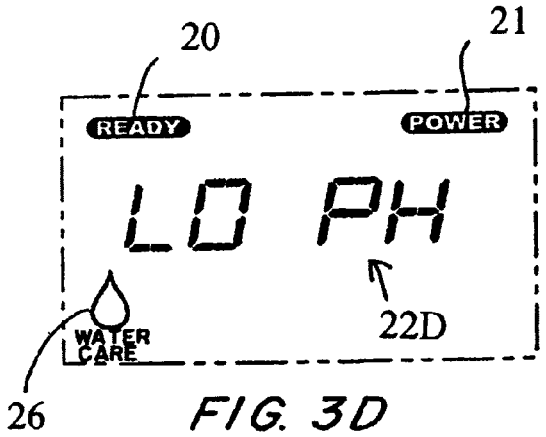
Figure 3E:
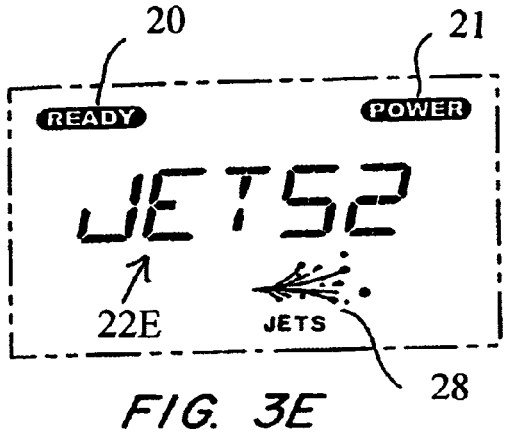

Referring now to FIGS. 3A through 3E, a variety of displays that may be shown by the display 11 of the remote control 10 are illustrated. FIG. 3A shows a set temperature display. Note that the Ready and Power icons 20 and 21, respectively, are illuminated, as well as the Set and Temp icons, 24 and 23, respectively; and, the temperature setting of 103° F. is shown. FIG. 3B shows the display when the remote control 10 is set in the Light mode. Note that the word LIGHT 22B appears across the display array 22, while the Light icon 27 is illuminated. FIG. 3C shows the spa 16 is clean when in the Water Care mode, wherein icon 26 is illuminated and the word CLEAN 22C appears across the display array 22. FIG. 3D shows the display when the status of the spa has a low PH, or high acidity. Note that the Water Care icon 26 is illuminated and the term LO PH 22D appears across the display array 22. FIG. 3E shows the display when the remote is in the Jet setting mode. Note that the Jets icon 28 is lit and the term JETS2 22E appears across the display array 22. The term JETS2 refers to the water-jet pump number 2.

Figure 4:
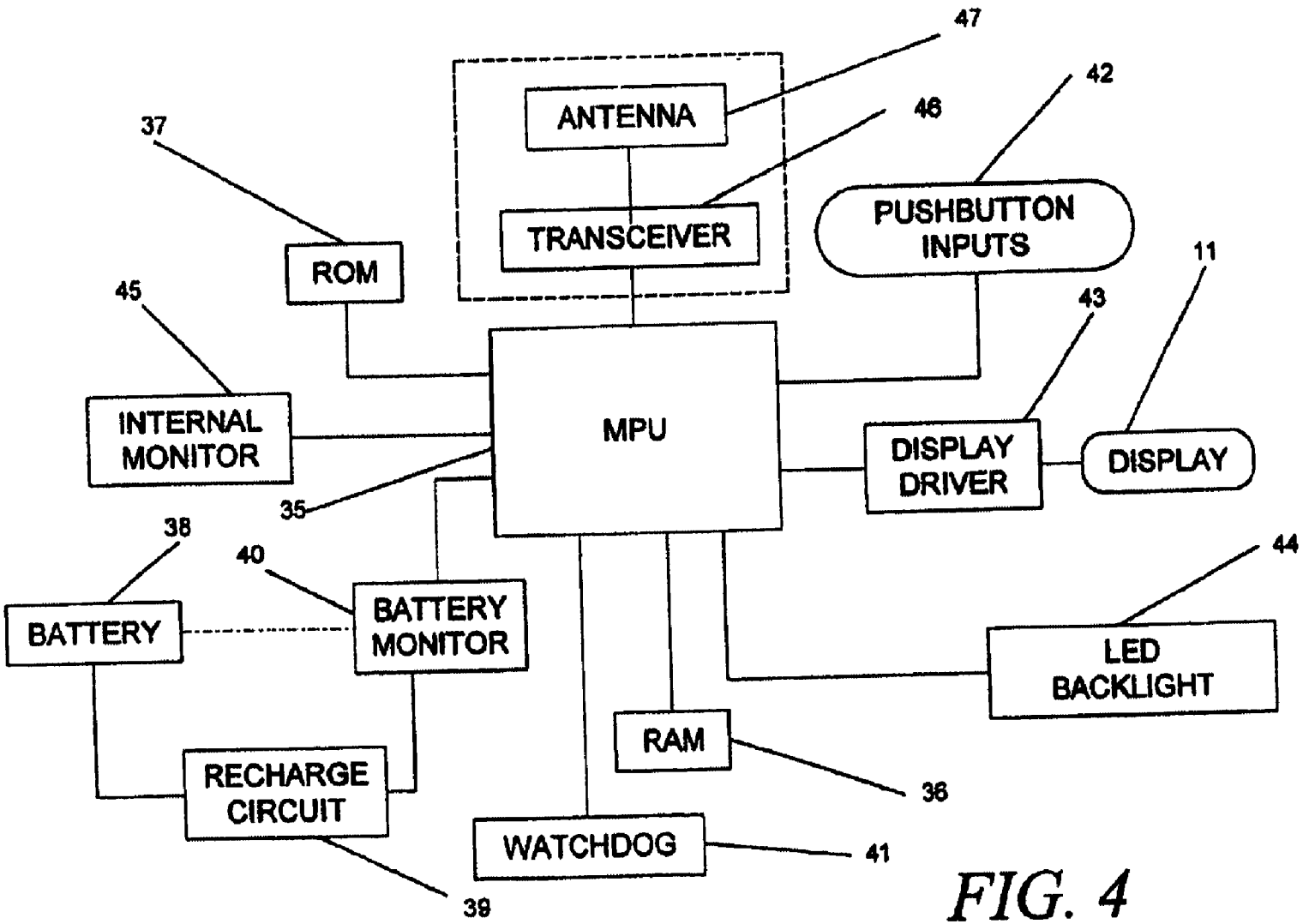
FIG. 4 is a block diagram of the electronic structure of the remote control.

Referring now to FIG. 4, the electronics of the remote control 10 are illustrated. The center of the remote control 10 is a Microprocessor Unit ("MPU") 35. The MPU 35 has coupled thereto a RAM 36 and a ROM 37, which are conventional peripherals to a microprocessor and will not be described further herein. Also, the MPU 35 is powered by a battery 38, which in a specific embodiment includes three AAA batteries. A battery recharge circuit 39 and a battery monitor 40 are coupled between the battery 38 and the MPU 35, which are also well known in the art and will not be amplified further herein. A watchdog circuit 41 is also coupled to the MPU 35 to make sure the commands are being executed properly and to reset internal program functions.

Pushbutton inputs 42 are coupled to input terminals of the MPU 35 to receive signals from the mode button 12 or the +/– selection switch 13. Display Driver 43 is coupled to outputs of the MPU 35 in a conventional manner, which in turn drive the display 11 described hereinabove. The display 11 also includes a back light 44 made up of Light Emitting Diodes ("LED"). An Internal Monitor 45 is coupled to the MPU for the purpose of determining any MPU non-conforming operation. RF signals are transmitted from the remote control 10 or received from the main control 15 by means of a transceiver 46 and an antenna 47. The operation of the remote control 10 will be more fully appreciated hereinafter with the description accompanying FIGS. 6A and 6B.

Figure 5A:
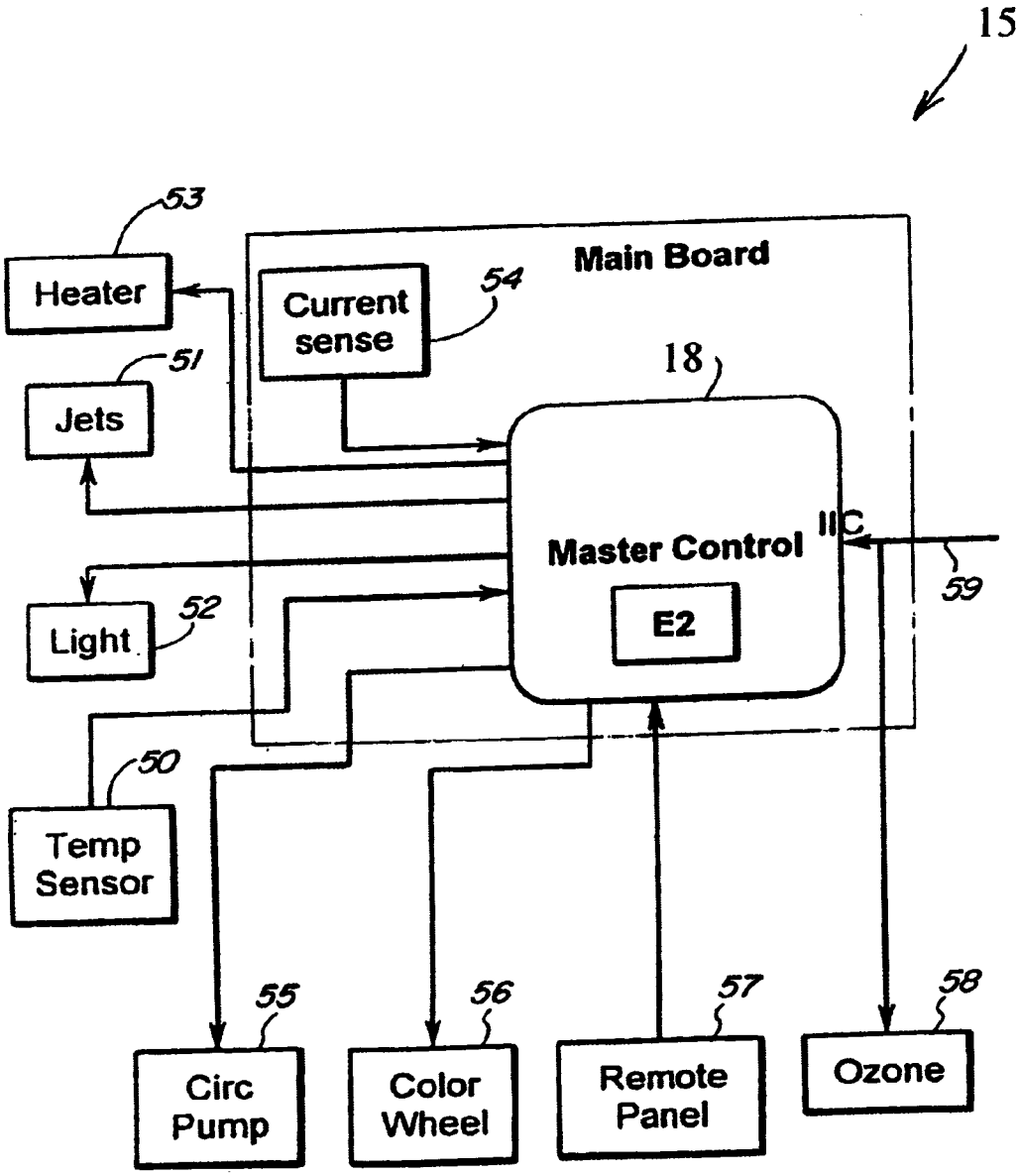
FIGS. 5A and 5B combined form a block diagram of the system including the master control.
Figure 5B:
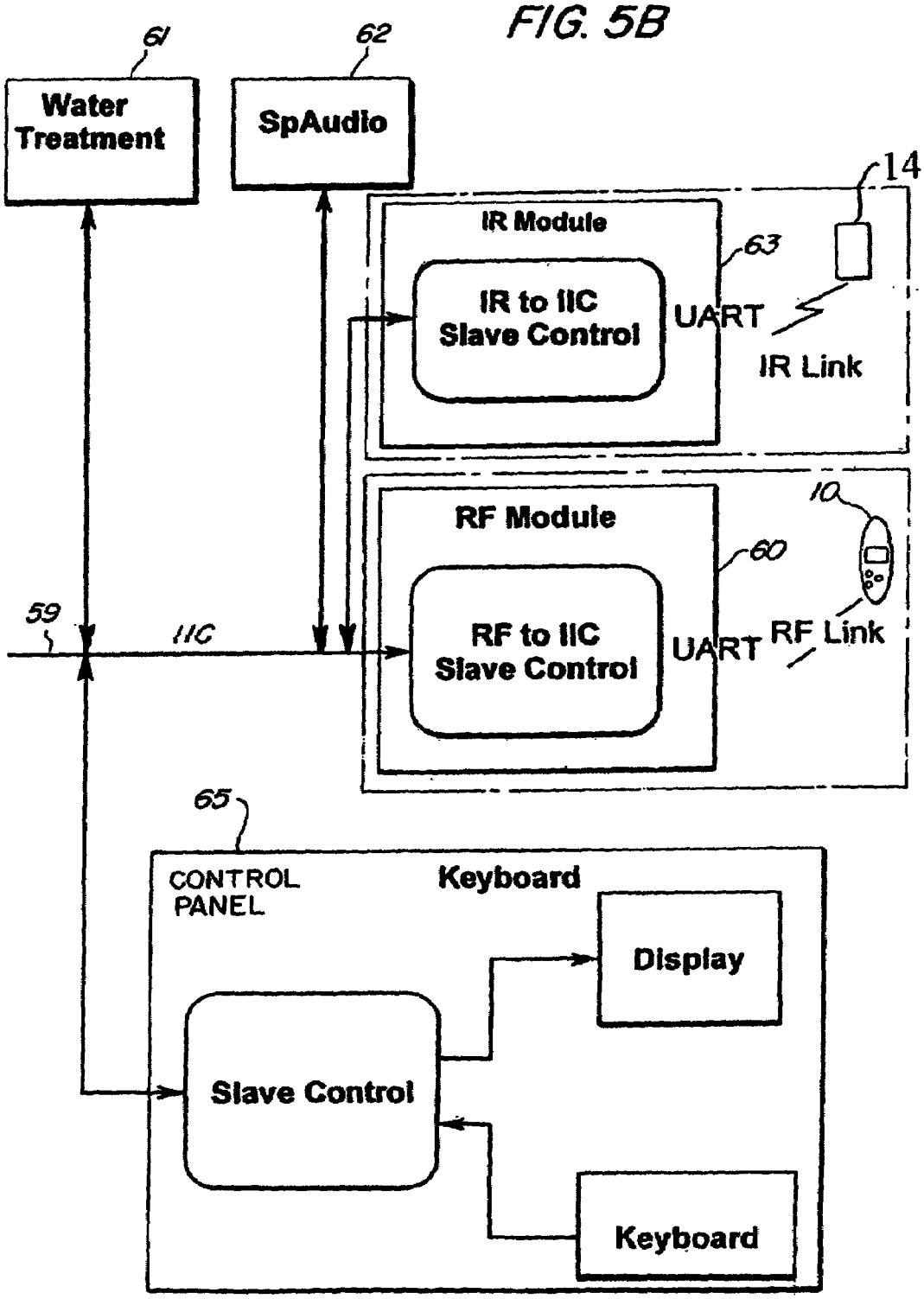

At this juncture, reference is made to FIGS. 5A and 5B for a block diagram of the system including the master control 18 which with RF module 60 is the Main Control 15. A number of sensing devices are coupled to the master control 18, such as a Temp Sensor 50, which senses the spa water temperature. Spa Lights 52 are controlled by the master control 15 as are Jets 51 and Heater 53. A Current Sense 54 senses the current in the water heater and jet pumps and provides appropriate inputs indicative thereof to the master control 18. A water circulating pump 55 and a color wheel 56 are likewise controlled by the master controller 18. The term color wheel refers to an apparatus for changing the color of the light in the spa, but not necessarily by an actual color wheel. A remote control panel 57 for the spa 16 also provides inputs to the master control 18.

An ozone sensor 58 provides inputs to the master control 15 through an IIC (Inter Integrated Circuit) bus 59, which is adapted for the IIC protocol. The IIC protocol is well known in the art and will not be amplified further herein.

Referring now to FIG. 5B, the IIC bus 59 is coupled to an RF interface module 60, which performs an RF to IIC slave control. The RF interface module 60 includes a UART (Universal Asynchronous Receiver/Transmitter), which is an integrated circuit used for serial communications, containing a transmitter (parallel-to-serial converter) and a receiver (serial-to-parallel converter), each clocked separately. UART's are well known in the industry and will not be discussed further herein. The remote control 10, described hereinabove, is adapted to communicate with the master controller 18 by means of the UART.

Also coupled to the IIC bus 59 are such devices as a Water Treatment 61 and a SpAudio 62, which is disclosed in greater detail in U.S. patent application Ser. No. 09/865,127, entitled SPA AUDIO SYSTEM OPERABLE WITH A REMOTE CONTROL, filed May 24, 2001, now U.S. Pat. No. 6,516,070, and assigned to the assignee hereof.

An IR module 63 is also coupled to the IIC bus 59. This module is used for servicing the spa. An infrared ("IR") link couples a remote control 63. The remote 64, may, for example, comprise a PalmPilot device used by service technicians. PalmPilot is a product available from Palm, Inc. of Santa Clara, Calif. 95052.

A separate control panel 65 for the spa 16 may likewise be coupled to the IIC bus 59.

Figure 6A:
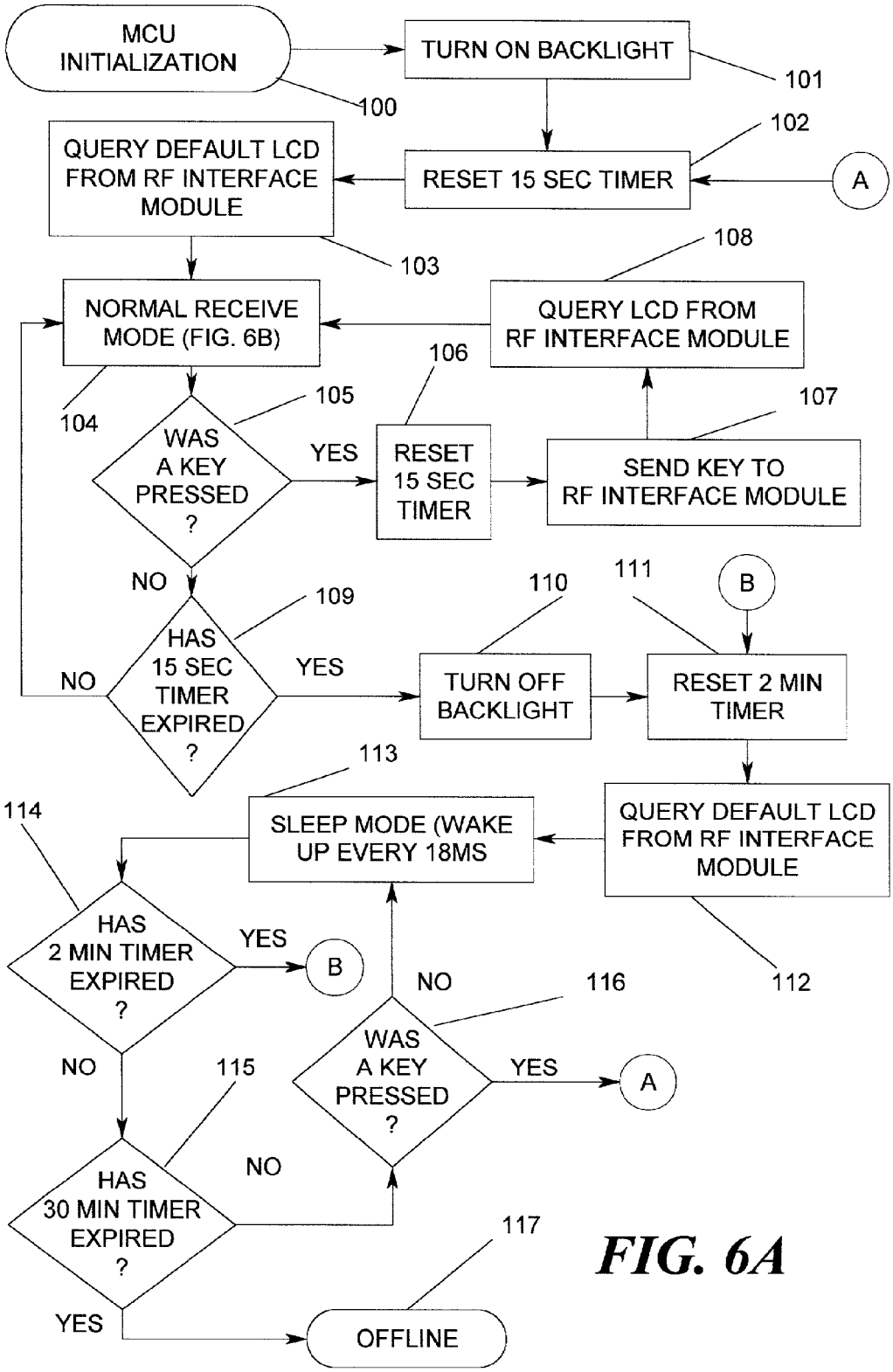
FIGS. 6A and 6B combined form a flow chart illustrating the process for operation of the remote control of the present invention.
Figure 6B:
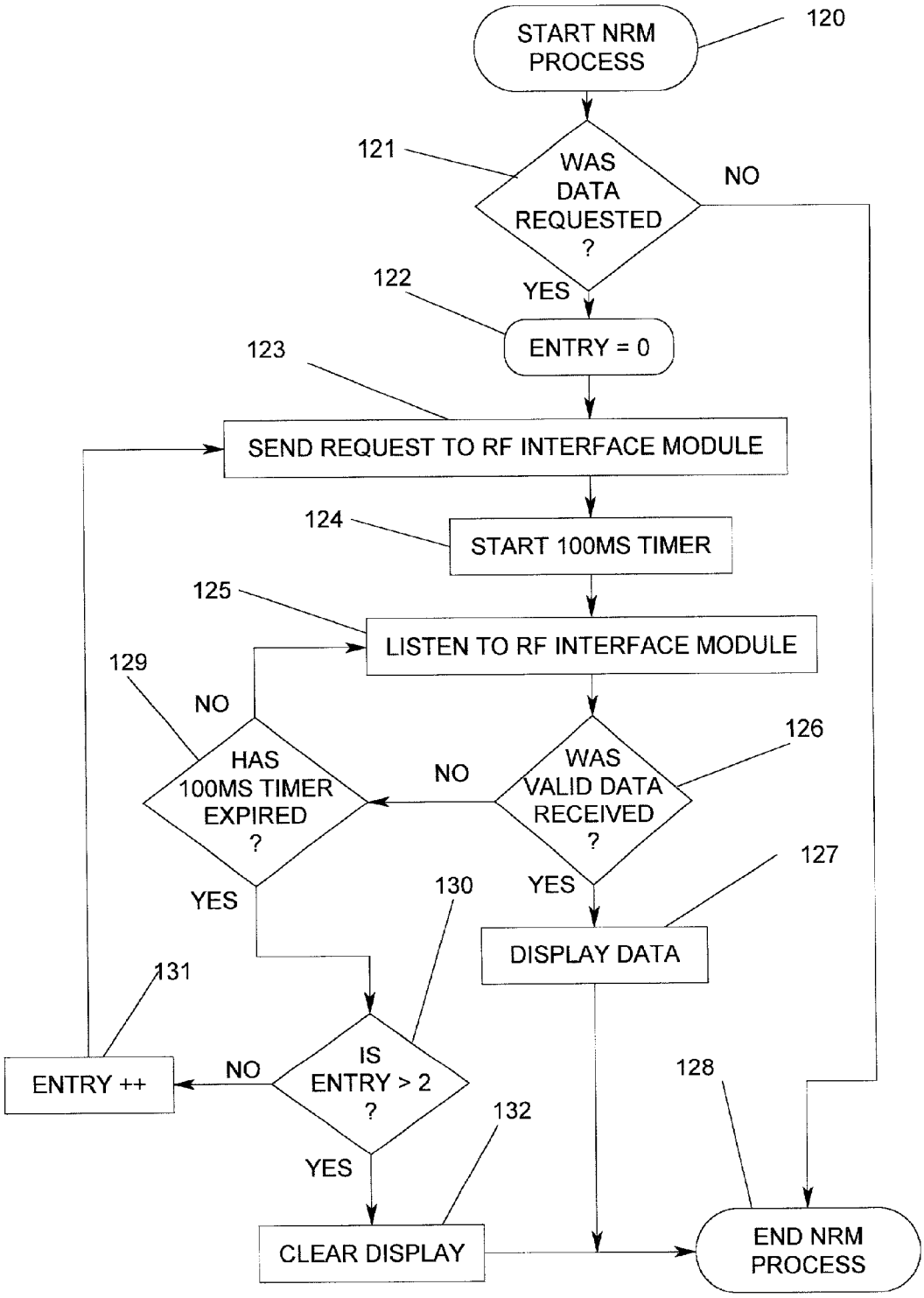

Referring now to FIG. 6A, a flow chart of the operation of the remote control 10 is illustrated. The process begins with an initialization of the MPU 35 (bubble 100) followed by the turning on of the LED back-light 44 (block 101). After this, a 15-second timer is reset (block 102) and a query is made (block 103) for a default LCD from the RF interface module 60. Next, the remote control 10 is placed in normal receive mode (block 104) which is illustrated in FIG. 6B and amplified hereinafter. After this, an inquiry is made as to whether or not a key was pressed on the remote control 10 (diamond 105). If the answer to this inquiry is yes, then the 15-second timer is reset (block 106) and this key value is sent to the RF interface module 60 (block 107). Next, the LCD from the RF interface module is queried (block 108) and the remote control 10 is again placed in the normal receive mode (block 104).

If a key was not pressed, then another inquiry is made as to whether or not the 15-second timer has expired (diamond 109). If the answer to this inquiry is no, then the remote control is placed in the normal receive mode (block 104). On the other hand, if the answer to this inquiry is yes, then the back-light is turned off (block 110) and the 2-minute timer is reset (block 111). Next, the default LCD from the RF interface module 60 is queried (block 112) and the remote control 10 enters into a sleep mode with a wake up every 18 milliseconds (block 113). After this, an inquiry is made as to whether or not the 2-minute timer has expired, and if yes it is reset (connector B returns back to the block 111).

If the 2-minute timer has not expired, then yet another inquiry is made as to whether or not the 30-minute timer has expired (diamond 115). If the answer to this inquiry is no, then still another inquiry is made as to whether or not a key was pressed (diamond 116). If the answer to this inquiry is no, then the remote control enters the sleep mode with a wake up every 18 milliseconds (block 113). On the other hand, if the answer to this inquiry is yes, then a return is made back to the block 102 to reset the 15-second timer (via the connector A). If the 30-minute timer has expired (diamond 115) then the remote control goes off line (bubble 117).

Referring now to FIG. 6B, a flow chart of the NRM process (Normal Receive Mode) is shown. The process begins with a start bubble 120 followed by an inquiry as to whether or not data was received (diamond 121). If the answer to this inquiry is yes, then Entry is set equal to zero (ENTRY=0, bubble 122). ENTRY counts the number of communication attempts between the remote and the RF module. Next, the request is sent to the RF interface module 60 (block 123) and the 100 millisecond timer is started (block 124). After this, the RF remote listens to the RF interface module 60 (FIG. 5B) (block 125) for data to determine what should be displayed. An inquiry is then made as to whether or not valid data was received (diamond 126). If the answer to this inquiry is yes, then the data is displayed (block 127) and the process ends (bubble 128). Note that if no data was requested (diamond 121), then the NRM process ends.

If the data received was not valid, then another inquiry is made as to whether or not the 100 millisecond timer has expired (diamond 129). If the answer to this inquiry is no, then a return is made back to the block 125. On the other hand, if the 100 millisecond timer has expired then yet another inquiry is made as to whether or not Entry is greater than 2 (diamond 130). This is done for the purpose of making sure that the remote and the RF interface module 60 have communicated correctly. If ENTRY is not greater than 2, then ENTRY is incremented and a return is made back to the block 123 for sending the request back to the RF interface module 60. On the other hand, if Entry is greater than 2, then the display is cleared (block 132) and the NRM process ends (bubble 128).

The methods and apparatus of the present invention, or certain aspects or portions thereof, may take the form of program code (i.e., instructions) embodied in tangible media, such as floppy diskettes, CD-ROMS, hard drives, or any other machine-readable storage medium, wherein, when the program code is loaded into and executed by a machine, such as a computer, the machine becomes an apparatus for practicing the invention. The methods and apparatus of the present invention may also be embodied in the form of program code that is transmitted over some transmission medium, such as over electrical wiring or cabling, through fiber optics, or via any other form of transmission, wherein, when the program code is received and loaded into and executed by a machine, such as a computer, the machine becomes an apparatus for practicing the invention. When implemented on a general-purpose processor, the program code combines with the processor to provide a unique apparatus that operates analogously to specific logic circuits.

While the invention has been particularly shown and described with reference to a preferred embodiment, it will be understood by those skilled in the art that various changes in form and detail may be made therein without departing from the spirit and scope of the invention.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A spa system including a remote control for controlling operation of a spa, said system comprising:

a remote control comprising: a microprocessor; memory connected to the microprocessor; a mode button connected for communication with the microprocessor; a plurality of control buttons connected for communication with the microprocessor; a display connected to the microprocessor; and a first antenna connecting for communication with the microprocessor and for transmitting signals and receiving signals; and a main control at the spa for controlling and sensing a multiplicity of functions of the spa comprising a second antenna responsive to signals from the first antenna and sending signals to the first antenna, the main control sending signals to the remote control for displaying information on the display of the remote control and determining the function of the plurality of control buttons on the remote control, as determined by the information sent to the display of the remote control; whereby the functionality of the control buttons of the remote control is changed with different display signals being sent by the main control.

2. The spa system of claim 1 wherein the mode button of the remote control selects a spa function to be controlled.

3. The spa system of claim 2 wherein the selected spa function to be performed by the main control is caused to be displayed on the display of the remote control by information sent by the main control.

4. The spa system of claim 3 wherein the control buttons when activated, send control signals to the main control that are recognized by the main control as control signals for the spa functions being displayed on the display of the remote control.

5. The spa system of claim 4 wherein the remote control further comprises an RF transceiver coupled between an output of the microprocessor and the first antenna.

6. The spa system of claim 5 wherein the plurality of control buttons on the remote control comprise two push-buttons.

7. A remote control for communicating with a main control disposed for sensing the status of and controlling a multiplicity of functions of an apparatus, the main control having a first antenna for sending signals to the remote control and receiving signals from the remote control, the remote control comprising:

a processor;

a second antenna adapted for sending signals from the processor to the main control and receiving signals from the main control;

a memory coupled to the processor;

a plurality of control buttons coupled to the processor;

a display connected to the processor;

a mode button coupled to the processor adapted for sending signals to the main control that cause the main control to send signals back to the remote control for displaying certain information on the display, the main control determining the function of the control buttons of the remote control in relation to the information being displayed on the remote control; whereby the functionality of the control buttons of the remote control is changed with different display signals being sent by the main control.

8. The remote control of claim 7 wherein the plurality of control buttons comprise two push-buttons.

9. The remote control of claim 7 wherein the remote control further comprises an RF transceiver coupled between an output of the processor and the second antenna.

10. In a remote control, having an alpha-numeric display and a plurality of push-buttons, for communicating with a main control disposed for sensing and controlling a multiplicity of functions of an apparatus, a method for communicating with the main control comprising:

a. determining if a push-button on the remote control has been depressed, and if so;

b. resetting a timer and placing said remote control in transmit mode;

c. transmitting a data signal to the main control indicative of the depressed push-button;

d. resetting a timer and placing the remote control in receiving mode; and, e. receiving signals from the main control for displaying information, the displayed information determining the function of the push-buttons on the remote control, the functionality of the push buttons on the remote control being changed with different display signals being sent by the main control.

11. The method of claim 10 wherein if it is determined that a push-button has not been depressed, further including the steps of:

f. determining if a 15 second timer has expired, and if so;

g. turning off a back light in the display of the remote control.

12. The method of claim 10 wherein if no push-button has been depressed for over two minutes, further including the steps of:

f. placing the remote control in a sleep mode;

g. determining if a push-button has been depressed, and if not;

h. putting the remote control off line.

13. The method of claim 10 further including the step of placing the remote control in a normal receive mode.

14. The method of claim 13 further including the steps of:

f. determining if data is requested, and if so;

g. sending a request to the master control;

h. listening for a reply from the master control, and if valid data is received;

i. displaying the valid data.

15. The method of claim 14 further including the step of determining if more than two requests for data have been made, and if so, clearing the display in the remote control.

16. A storage medium encoded with machine-readable computer program code for use in a remote control for communicating with a master control disposed for sensing and controlling a multiplicity of functions of a spa, wherein, when the computer program code is executed by the remote control, the remote control performs a method for transmitting signals to the main control and for receiving signals back from the main control, the method comprising:

a. determining if a push-button on the remote control has been depressed, and if so;

b. resetting a timer and placing the remote control in transmit mode;

c. transmitting a data signal to the main control at the spa indicative of the depressed push-button;

d. resetting a timer and placing the remote control in receive mode; and e. receiving signals from the main control for displaying information, the displayed information determining the function of push-buttons on the remote control, the functionality of the push buttons on the remote control being changed with different display signals being sent by the main control.

17. The medium of claim 16 further including the step of placing the remote control in a normal receive mode.

18. The medium of claim 17 further including the steps of:

f. determining if data is requested, and if so;

g. sending a request to the master control;

h. listening for a reply from the master control, and if valid data is received;

i. displaying the valid data on the display in the remote control.

19. The medium of claim 18 further including the step of determining if more than two requests for data have been made, and if so, clearing the display of the remote control.

* * * * *